US006296575B1

(12) United States Patent
Harris

(10) Patent No.: US 6,296,575 B1
(45) Date of Patent: Oct. 2, 2001

(54) GOLF RAKE

(76) Inventor: Gregory Harris, 2908 Pheasant Run, Edmond, OK (US) 73003

( * ) Notice: Subject to any disclaimer, the term of this patent is extended or adjusted under 35 U.S.C. 154(b) by 0 days.

(21) Appl. No.: 09/421,150

(22) Filed: Oct. 19, 1999

(51) Int. Cl.[7] ..... A63B 53/00

(52) U.S. Cl. ..... 473/286; 473/219; 294/19.2; 56/400.19

(58) Field of Search ..... 294/24, 19.2; 56/400.01, 56/400.08; 473/286

(56) References Cited

U.S. PATENT DOCUMENTS

| | | | | |
|---|---|---|---|---|
| D. 368,949 | | 4/1996 | Evans et al. | D21/234 |
| 4,236,742 | * | 12/1980 | Florence | 294/24 |
| 4,871,029 | | 10/1989 | Rosin | 172/378 |
| 5,100,148 | | 3/1992 | Smith | 273/186 |
| 5,207,625 | | 5/1993 | White | 482/111 |
| 5,305,591 | * | 4/1994 | Gibson, Jr. | 56/400.01 |
| 5,487,260 | * | 1/1996 | Proffit | 56/400.04 |
| 5,590,924 | * | 1/1997 | Quinn et al. | 56/400.01 |
| 5,690,559 | | 11/1997 | Julius | 473/286 |
| 5,758,915 | * | 6/1998 | Quinn et al. | 56/400.01 |
| 5,927,058 | * | 7/1999 | Hsu | 56/400.04 |

* cited by examiner

*Primary Examiner*—Mark S. Graham
*Assistant Examiner*—Raeann Gorden
(74) *Attorney, Agent, or Firm*—Dunlap, Codding & Rogers, P.C.

(57) ABSTRACT

A rake and method for golf training by an individual are provided. The rake includes a shaft and a rake head. The shaft has a first end and a second end. The rake head is secured to the second end of the shaft and has a plurality of flexible tines, each tine having a proximal and a distal end. The distal end of each of the tines is spatially disposed from each tine distal end other and disposed in a substantially coplanar relationship. The shaft is angularly disposed relative to a line extending from a first outer tine of the rake head to a second outer tine of the rake head, and in a non-coplanar relationship relative to a plane perpendicular to the line.

8 Claims, 3 Drawing Sheets

GOLF RAKE

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to a rake, and more particularly, but not by way of limitation, to a rake for use by an individual as a golf training aid.

2. Description of Related Art

The game of golf is enjoyed by a growing number of people. Golfers continuously strive to develop and maintain a successful golf swing. Golf training aids are frequently employed for the purpose of developing hand and arm muscle strength and memory. The training aids attempt to promote correct golf posture and stance, as well as the proper swing arc.

While many useful golf training aids exist which improve a golfer's playing technique, the golfer is precluded from engaging in other activities while playing golf or implementing a golf training aid. Unfortunately, the avid golfer often encounters house-hold responsibilities, such as ordinary yard work, which interfere with golf play and practice time.

Many yard implements, such as ordinary utility rakes, exist which the golfer may employ for such yard work. However, these rakes are not suited for use as golf training aids since they are not properly shaped to promote correct golf technique. Therefore, while the golfer may attempt to utilize such implements as mock golf clubs, the golfer realizes no golf training value from their use beyond the yard work they are designed to perform.

To this end, a need exists for a rake for use as a golf training aid by an individual engaged in ordinary yard work. It is to such a device that the present invention is directed.

SUMMARY OF THE INVENTION

In one aspect, the present invention is directed to a rake for use as a golf training aid by an individual engaged in ordinary yard work. The rake includes a shaft and a rake head. The shaft has a first end and a second end, the first end of the shaft defining a grip. The rake head is secured to the second end of the shaft and includes a plurality of flexible tines, each tine having a proximal and a distal end. The distal end of each of the tines is spatially disposed from each other distal end and disposed in a substantially coplanar relationship. The shaft is angularly disposed relative to a line extending from a first outer tine of the rake head to a second outer tine of the rake head, and the shaft is in a non-coplanar relationship relative to a plane perpendicular to the line.

In another aspect, the present invention is directed to a method of golf training implementing a rake. The first step is to provide an individual with a rake, such as the rake previously described. The next step is for the individual using a golf gripping technique to grasp the grip the rake. The next step is to simulate a golf swing wherein the distal ends of the plurality of tines of the rake generally uniformly contact the ground substantially adjacent the individual such that the plurality of tines rakingly engage the ground in a golf swing raking motion.

These and other objects and advantages of the present invention will become readily apparent to those skilled in the art upon reading the following detailed description and claims and by referring to the accompanying drawings.

BRIEF DESCRIPTION OF THE SEVERAL VIEWS OF THE DRAWING

FIG. 6 is a pictorial representation of an individual raking the ground with the golf rake of the present invention.

DETAILED DESCRIPTION OF THE INVENTION

Figure 1:
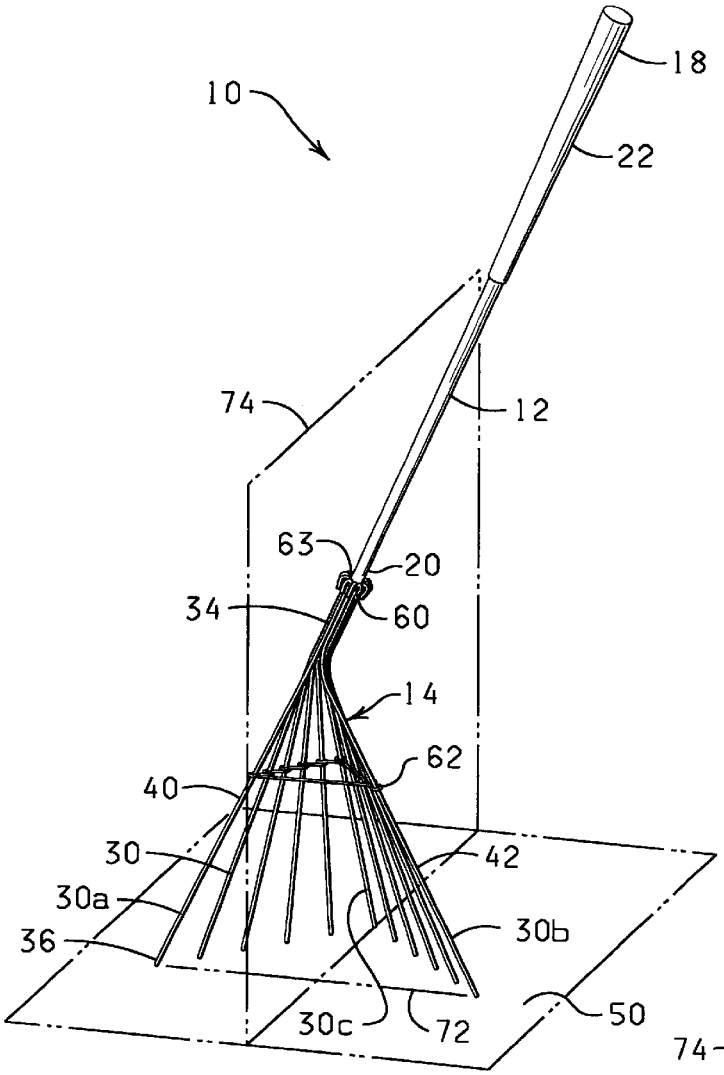
FIG. 1 is a perspective view of a golf rake constructed in accordance with the present invention showing the respective planar relationship of a rake head assembly and a shaft of the present invention.
Figure 2:
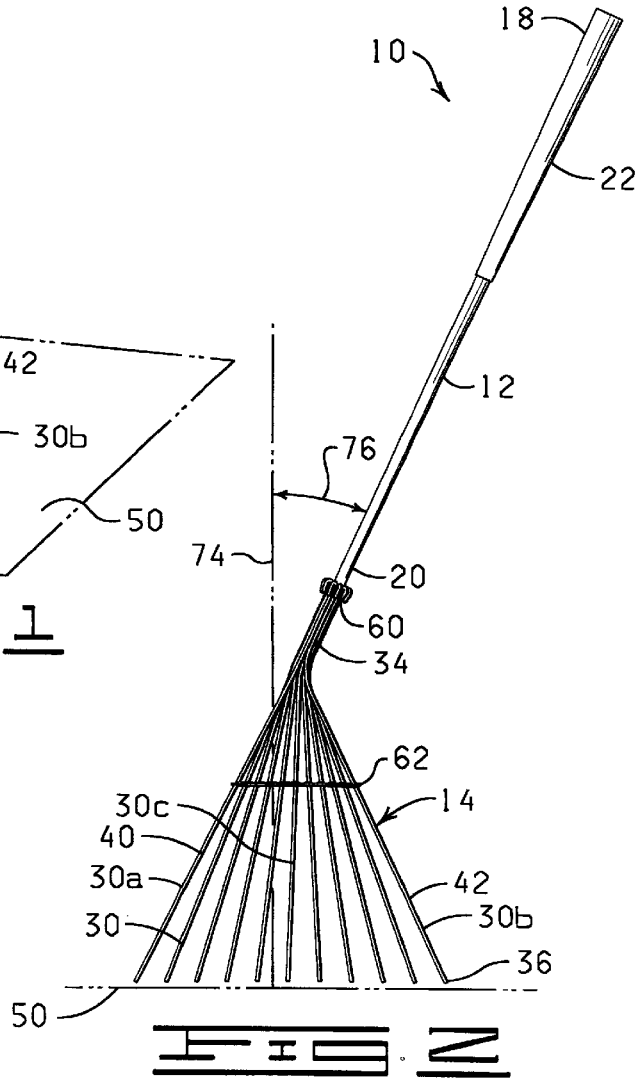
FIG. 2 is a front elevational view of the golf rake of FIG. 1.

Referring now to the drawings, and more particularly to FIGS. 1 and 2, a golf rake 10 constructed in accordance with the present invention is illustrated. The golf rake 10 of the present invention is a simple but effective device for use by an individual as a golf training aid while performing ordinary yard work.

The golf rake 10 broadly includes a shaft 12 and a rake head assembly 14. The shaft 12 is preferably a typical golf club shaft constructed of a relatively rigid material, such as graphite, or any other suitable material. The shaft 12 is characterized as having a first end 18 and a second end 20. The rake head assembly 14 is connected to the second end 20 of the shaft 12. The shaft 12 can be formed to be any length such that the golf rake 10 becomes comparable in length to a standard golf club. Therefore, the most efficient length of the shaft 12 will depend on the height of the individual using the golf rake 10.

The first end 18 of the shaft 12 is provided with a grip 22 dimensioned to be gripped by a hand of an individual in a conventional golf club gripping technique, such as a baseball, overlapping, or interlocking grip. The grip 22 can any type of golf club grip material widely used and readily available, or other material formed about the first end 18 of the shaft 12 which aids in grasping the first end 18 of the shaft 12 by the hands of an individual. The grip 22 is bondingly attached to the first end 18 of the shaft 12 with a bonding material, such as epoxy (not shown)

The rake head assembly 14 is preferably secured to the second end 20 of the shaft 12 with a bonding material, such as an epoxy (not shown). However, the rake head assembly 14 may be attached to the second end 20 of the shaft 12 by other means, such as welding, mechanical attachment, or the like.

The rake head assembly 14 is provided with a plurality of flexible tines 30. Each of the tines 30 is substantially cylindrical and constructed of a substantially rigid material, such as metal or polymeric material. Although the tines 30 of the present embodiment are substantially cylindrical, it should be understood that other configurations, such as generally rectangular, may also be implemented and remain within the spirit and scope of the present invention.

Each of the tines 30 has a proximal end 34 and a distal end 36. The distal end 36 of each of the tines 30 is spatially disposed from each other distal end 36. Each of the tines 30 is substantially similar in construction and function and the tines 30 only vary in length. Thus, for purposes of clarity, only a first outer tine 30*a*, a second outer tine 30*b*, and third outer tine 30*c* will be described.

The length of each of the tines 30 varies, depending upon the position of each of the tines 30 along the rake head assembly 14. That is, along a first outer side 40 of the rake head assembly 14, the length of each of the tines 30 increases from the first outer tine 30*a* to the third outer tine 30*c*, the first outer tine 30*a* being the shortest and the third outer tine 30*c* being the longest. Similarly, along a second outer side 42 of the rake head assembly 14 the length of each of the tines 30 increases from the second outer tine 30*b* to the third outer tine 30*c*, the second outer tine 30*b* being the shortest and the third outer tine 30*c* being the longest. As illustrated in FIG. 1, the variation in length of the tines 30 provides for the distal end 36 of each of the tines 30 to be disposed in a substantially coplanar relationship relative to a plane 50.

The rake head assembly 14 has an upper retaining member 60 and a lower retaining member 62. The upper retaining member 60 is disposed about the proximal end 34 of the tines 30 such that the tines 30 are gathered together to form a shaft receiving chamber 63. The upper retaining member 60 may be constructed of any polymeric material or metal, such as flexible wire, capable of retaining the plurality of flexible tines 30 gathered together.

Figure 3:
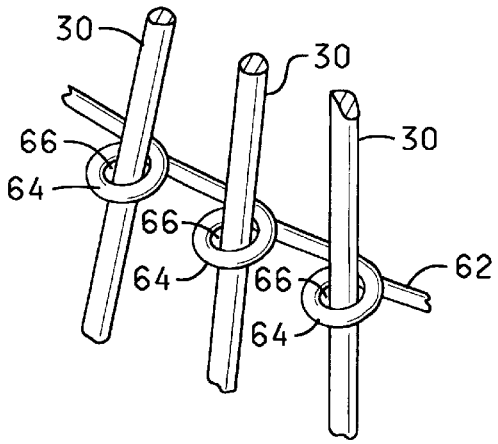
FIG. 3. is a cut-away portion of the golf rake of FIG. 2. illustrating the rake head assembly of the present invention in more detail.
Figure 4:
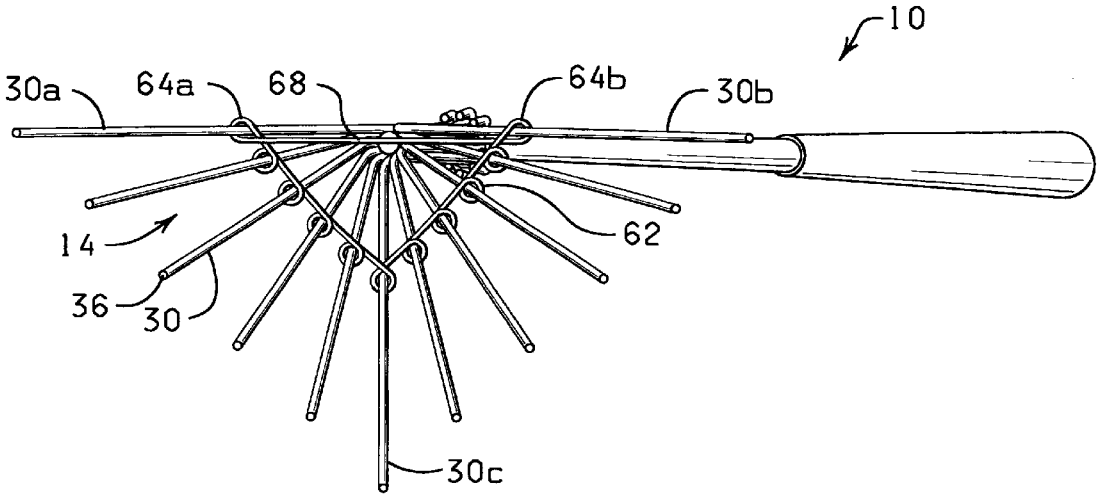
FIG. 4 is a bottom plan view of the golf rake of the present invention illustrating the flexible tines of the rake head assembly arranged in a generally V-shaped disposition.

Referring to FIGS. 3 and 4, the lower retaining member 62 is medially disposed between the proximal and distal ends 34 and 36 of each of the tines 30 in a looping manner. A plurality of loops 64 of the lower retaining member 62 define a plurality of openings 66. Each of the tines 30 is disposed through one of the openings 66 such that the loop 64 holds the tine 30 medially between the proximal and distal ends 34 and 36 of the tine 30. The plurality of flexible tines 30 are retained spatially disposed from one another by the circumferential disposition of the lower retaining member 62 about each of the tines 30.

The lower retaining member 62 is provided with a securing portion 68 which extends from a first loop 64*a* to a second loop 64*b* for rigidly retaining the first loop 64*a* disposed from the second loop 64*b*. The lower retaining member 62 supports the tines 30 so as to be arranged in a generally non-linear shaped path from the first outer tine 30*a* of the rake head assembly 14 to the second outer tine 30*b* of the rake head assembly 14.

Referring now to FIG. 4, the tines 30 of the rake head assembly 14 are shown to be arranged in a generally V-shaped disposition. More particularly, the tines 30 are arranged in a manner such that the distal ends 36 of the tines 30 cooperate to form a triangular configuration from the first outer tine 30*a* and a second outer tine 30*b* to the third outer tine 30*c*.

Figure 5:
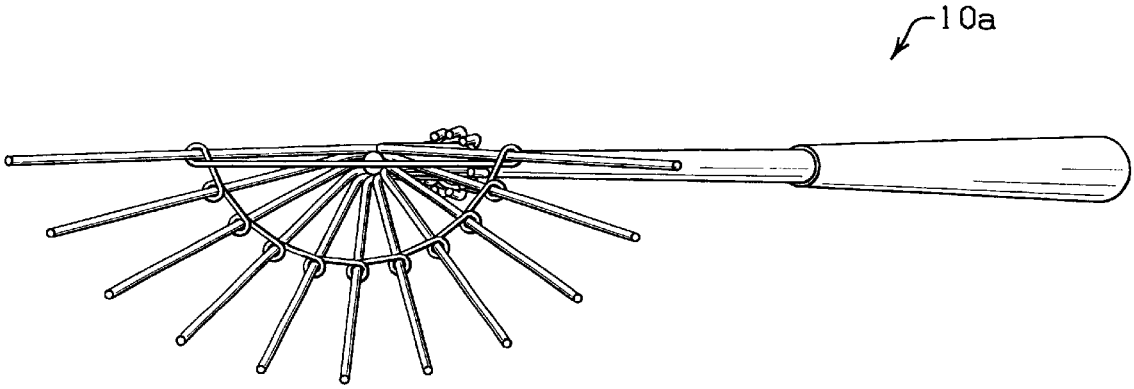
FIG. 5 is a bottom plan view of another embodiment of a golf rake of the present invention illustrating the flexible tines of the rake head assembly arranged in a generally curvilinear disposition.
Figure 5:
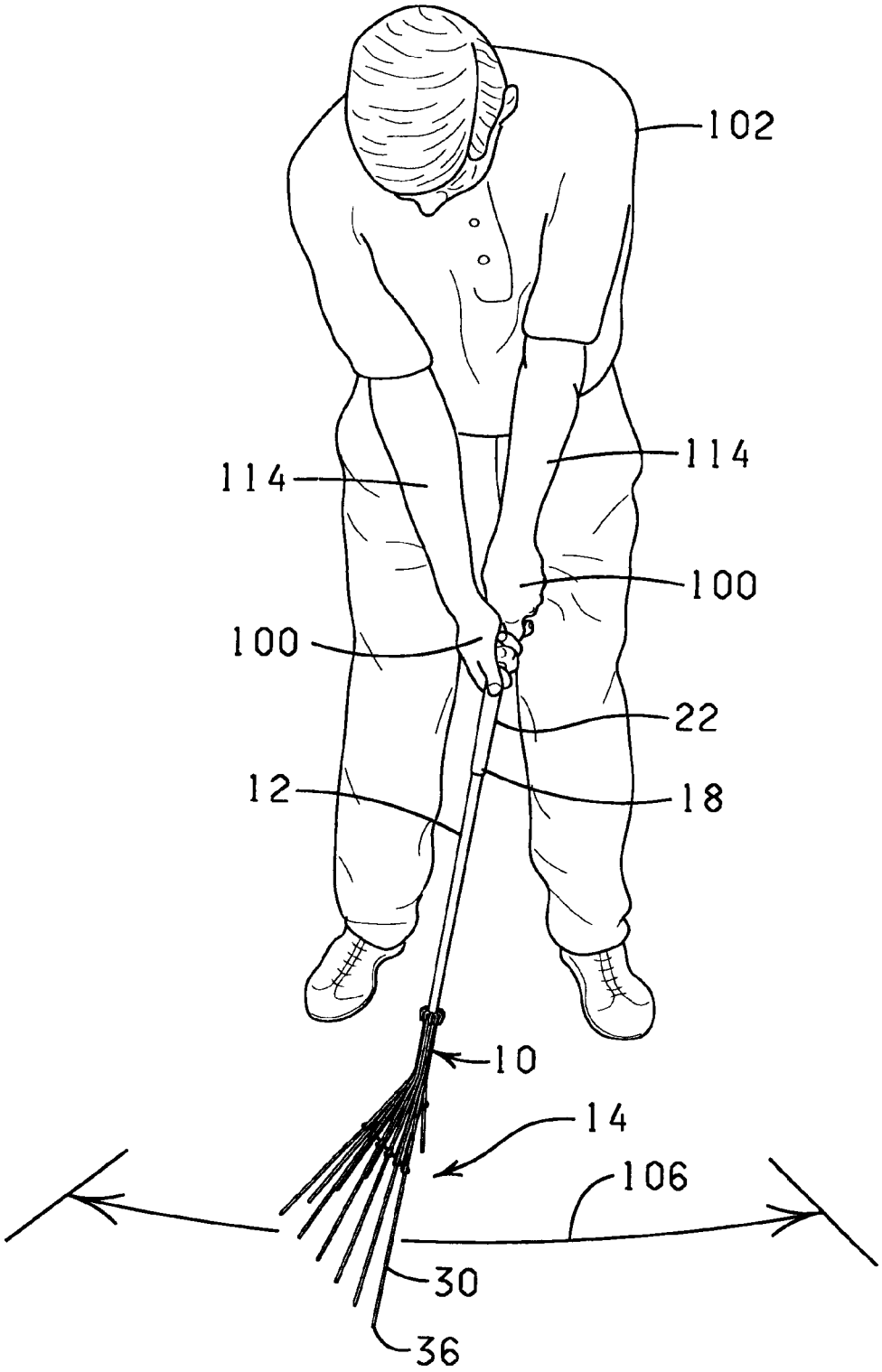

FIG. 5 illustrates an alternative embodiment of a golf rake 10*a* constructed in a manner similar to that of the golf rake 10 described above with the exception that the tines are arranged such that the distal ends of the tines are arranged in a curved path.

Referring again to FIGS. 1 and 2, the shaft 12 is angularly disposed relative to a line 72 extending from the first outer tine 30*a* of the rake head assembly 14 to the second outer tine 30*b* of the rake head assembly 14. Further, the shaft 12 is in a noncoplanar relationship relative to a plane 74 which is perpendicular to the line 72. The shaft 12 is disposed at an angle 76 relative to the plane 74. The angle 76 is greater than zero degrees, thus allowing the golf rake 10 to be positionable in a golf club like fashion. That is, the distal end 36 of each of the tines 30 is disposed in the plane 50 similar to the disposition of the club head of a standard golf club while the club head rests on the ground. The shaft 12 is angled relative to the plane 74 similar to the disposition of the shaft of a standard golf club.

Therefore, the unique angle 76 of the shaft 12 to the plane 74 relative to the rake head assembly 14 causes the golf rake 10 to simulate the general configuration of a standard golf club. This unique configuration allows the golf rake 10 to be wielded by an individual substantially in the same manner as in individual would wield a golf club while the individual employs the golf rake 10 for utility raking purposes.

FIG. 6 illustrates the golf rake 10 of the present invention being used as a golf training aid by an individual while engaged in ordinary yard work. More specifically, hands 100 of an individual 102 grasp the golf rake 10 by the grip 22 of the first end 18 of the shaft 12 using a golf club gripping technique. The golf club gripping technique can be any manner by which a golfer grasps a golf club about the grip of the golf club.

The individual 102 positions the golf rake 10 such that the distal end 36 of each of the tines 30 of the rake head assembly 14 engages the ground substantially adjacent and perpendicular relative to the individual 102. The golf rake 10 is angularly disposed in front of the individual 102 such that the distal end 36 of each of the tines 30 generally uniformly contacts the ground when the grip 22 of the shaft 12 is gripped by the hands 100 of the individual 102, using a conventional golf gripping technique.

The individual 102 then rakes the ground in an arcing motion, as indicated by a dotted line bearing the reference numeral 106, such that the distal end 36 of each of the tines 30 maintains substantial engagement with the ground from one side of the individual 102 throughout the arc substantially forward of the individual 102 to the other side of the individual 102, thereby creating a resistance while the raking motion simulates a golf swing. The individual 102 simulates a golf swing motion of the golf rake 10 whereby the distal end 36 of each of the tines 30 of the rake head assembly 14 generally uniformly contacts the ground substantially adjacent the individual 102 such that the tines 30 rakingly engage the ground 104 in a golf swing raking motion.

The individual 102 is required to exert sufficient force on the grip 22 of the shaft 12 so as to maintain substantial engagement with the ground of the distal end 36 of each of the tines 30. The frictional engagement of the distal end 36 of the tines 30 with the ground must be overcome by the individual 102 exerting additional force on the grip 22 of the shaft 12. The exertion of force on the grip 22 by the hands 100 of the individual 102 exercises the muscles of the hands 100 and arms 114 of the individual 102.

Accordingly, one of the advantages of the present invention is that in use, the golf rake 10 isolates the muscles of the hands 100 and arms 114 of the individual 102 such that the muscles of the hands 100 and arms 114 of the individual are sufficiently exercised. The golf rake 10 has the effect of strengthening and training the isolated muscles of the hands 100 and arms 114 used by the individual 102 for swinging the golf rake 10. Because the golf rake 10 allows the individual 102 to simulate a golf swing, the individual 102 strengthens and trains the golf related muscles used for swinging an ordinary golf club by use of the golf rake 10 of the present invention.

Another advantage of the present invention is that the arrangement of the tines 30 is useful as an ordinary utility rake for yard-work. The spatial disposition of the tines 30 promotes raking and gathering debris, such as sticks and leaves, which ordinarily collect in a residential yard while allowing smile materials, such as dirt and rocks, to pass between the tines 30.

The coplanar disposition of distal end 36 of each of the tines 30 relative to the plane 50 (see FIG. 1) promotes uniform contact of the distal end 36 of each of the tines 30 with the ground throughout the arcing motion of the simulated golf swing. Also, the arrangement of the tines 30 in a generally curvilinear or V-shaped path from the first outer tine 30*a* to the second outer tine 30*b* (see FIGS. 4 and 5) aids in collecting and gathering debris.

Finally, another advantage of the present invention is that the substantial rigidity of the tines 30 promotes durability and prevents breakage of the tines 30 when the distal end 36 of one of the tines 30 contacts a hardened surface, such as a rock or cemented debris. These utilitarian considerations of the rake head assembly 14, and specifically to the tines 30, provide the individual 102 with a device that is both useful in accomplishing yard work while simultaneously providing the benefits of a golf training aid.

From the above description it is clear that the present invention is well adapted to carry out the objects and to attain the advantages mentioned herein as well as those inherent in the invention. While a presently preferred embodiment of the invention has been described for purposes of this disclosure, it will be understood that numerous changes may be made which will readily suggest themselves to those skilled in the art and which are accomplished within the spirit of the invention disclosed and as defined in the appended claims.

What is claimed is:

1. A rake for use by an individual as a golf training aid, comprising;

a shaft having a first end and a second end; and a rake head secured to the second end of the shaft, the rake head having a plurality of flexible tines, each of the tines having a proximal end and a distal end, the distal end of each of the tines spatially disposed from one another, the shaft being angularly disposed relative to a plane extending perpendicular to a line extending from the distal end of a first outer tine of the rake head to the distal end of an opposing second outer tine of the rake head at an angle greater than zero degrees such that the distal end of each of the tines is simultaneously engageable with the ground so that the tines cooperate to collect debris and create resistance which exercises various muscles of the individual used for swinging a golf club upon the individual gripping a portion of the shaft using a golf club gripping technique and swinging the rake in a sweeping motion which simulates a golf swing.

2. The rake of claim 1 wherein the shaft is provided with a golf grip on the first end thereof dimensioned to be gripped by the hand of an individual using a golf club gripping technique.

3. The rake of claim 1 wherein the distal ends of the tines are arranged in a generally non-linear path from the first outer tine of the rake head to the second outer tine of the rake head.

4. The rake of claim 1 wherein the distal ends of the tines are arranged in a generally curvilinear shaped path from the first outer tine of the rake head to the second outer tine of the rake head.

5. The rake of claim 1 wherein the distal ends of the tines are arranged in a generallyv-shaped path from the first outer tine of the rake head to the second outer tine of the rake head.

6. A golf training method for an individual, comprising:

providing a rake, comprising:

a shaft having a first end and a second end; and a rake head secured to the second end of the shaft, the rake head having a plurality of flexible tines, each of the tines having a proximal end and a distal end, the distal end of each of the tines spatially disposed from each other, the shaft being angularly disposed relative to a plane extending perpendicular to a line extending from the distal end of a first outer tine of the rake head to the distal end of an opposing second outer tine of the rake head;

gripping the first end of the shaft with the hands of the individual using a golf club gripping technique;

assuming a golf-like posture wherein the first end of the shaft is gripped with the golf club gripping technique and the distal ends of each of the tines are placed in contact with the ground in front of the individual; and swinging the rake in a sweeping motion which simulates a golf swing so that the tines cooperate to collect debris and create resistance thereby exercising various muscles of the individual used for swinging a golf club.

7. The method of claim 6 wherein the first end of the shaft of the rake is provided with a golf grip dimensioned to be gripped by the hand of an individual using a golf club gripping technique.

8. A golf training method for an individual, comprising:

providing a rake, comprising:

a shaft having a first end and a second end, the first end of the shaft defining a hand grip dimensioned to be gripped with hands of an individual using a golf club gripping technique; and a rake head secured to the second end of the shaft, the rake head having a plurality of flexible tines, each of the tines having a proximal end and a distal end, the distal end of each of the tines spatially disposed from each other, the shaft being angularly disposed relative to a plane extending perpendicular to a line extending from the distal end of a first outer tine of the rake head to the distal end of an opposing second outer tine of the rake head;

gripping the first end of the shaft of the rake with the hands of the individual using a golf club gripping technique;

positioning the rake such that the distal ends of the tines of the rake engage the ground substantially adjacent to and in front of the individual such that the distal ends of the plurality of tines generally uniformly contact the ground when the first end of the shaft is gripped by the hands of the individual; and raking the ground in an arcing motion which simulates a golf swing such that the plurality of tines maintain substantial engagement with the ground from a first side of the individual throughout the arc substantially forward the individual to a second side of the individual so as to collect debris and create resistance thereby exercising various muscles of the individual used for swinging a golf club.

* * * * *